US007811151B2

(12) United States Patent
Conrad

(10) Patent No.: US 7,811,151 B2
(45) Date of Patent: Oct. 12, 2010

(54) TOY AIRPLANE WITH FOLDABLE WINGS AND A SWITCH TO ACTIVATE A PLANE PROPELLER

(75) Inventor: Steve Conrad, Coeur d'Alene, ID (US)

(73) Assignee: Elliot Rudell, Torrance, CA (US)

( * ) Notice: Subject to any disclaimer, the term of this patent is extended or adjusted under 35 U.S.C. 154(b) by 824 days.

(21) Appl. No.: 11/413,380

(22) Filed: Apr. 27, 2006

(65) Prior Publication Data

US 2006/0264146 A1 Nov. 23, 2006

Related U.S. Application Data

(60) Provisional application No. 60/678,758, filed on May 5, 2005.

(51) Int. Cl.
*A63H 27/00* (2006.01)

(52) U.S. Cl. ..... 446/62; 446/63; 244/63

(58) Field of Classification Search ..... 446/57, 446/62–65, 232; 244/49, 62–63; *A63H 27/00*
See application file for complete search history.

(56) References Cited

U.S. PATENT DOCUMENTS 3,647,163 A * 3/1972 Sweeney ..... 244/49
5,129,852 A * 7/1992 Crisci et al. ..... 446/60
5,423,706 A * 6/1995 Chase ..... 446/62

* cited by examiner

*Primary Examiner*—Peter DungBa Vo
*Assistant Examiner*—Alex F. R. P. Rada, II
(74) *Attorney, Agent, or Firm*—Ben J. Yorks; Irell & Manella LLP

(57) ABSTRACT

A toy airplane with foldable wings. The wings can be folded before being launched by a launcher. When the toy airplane is launched the wind pressure maintains the wings in the folded position. When the toy airplane reaches a certain reduced speed, springs of the toy plane move the wings back into an unfolded position. Movement of wings into the unfolded position closes a switch and powers a propeller of the toy plane. The propeller can be powered by a battery within the toy plane fuselage. The combination of a motorized propeller, switch and folded wings provides a toy airplane that minimizes drag during launch and allows for extended flight after launch.

17 Claims, 7 Drawing Sheets

TOY AIRPLANE WITH FOLDABLE WINGS AND A SWITCH TO ACTIVATE A PLANE PROPELLER

REFERENCE TO RELATED APPLICATION

This application claims priority to provisional Application No. 60/678,758 filed on May 5, 2005.

BACKGROUND OF THE INVENTION

1. Field of the Invention

The present invention relates to a toy airplane.

2. Prior Art

There have been marketed various remote controlled airplanes. Remote controlled airplanes include one or more motors connected to a battery and a wireless receiver. Control commands are sent from a wireless controller. The inclusion of a battery and a motor allows the user to fly the toy airplane for a relatively long time period.

Mattel Toys marketed a toy airplane under the name SLING. The SLING product included a launcher that could be hooked to a toy airplane with a rubber band. The rubber band was released and launched the toy airplane. The wings of the SLING toy airplane could be folded upward before being launched. The folded wings reduced aerodynamic drag during the launch process. When the toy airplane reached a certain reduced speed the wings would unfold to provide stability for the toy plane.

Spinmaster Toys sold a toy airplane under the name JET BLASTER with wings that could be folded backwards before launch. The JET BLASTER toy airplane was also launched with a rubber band launcher. During the ascent of the plane the wind pressure maintained the wings in the folded position. The wings moved back into an unfolded position when the speed of the toy plane dropped to a certain level.

After the wings became unfolded the SLING and JET BLASTER toy airplanes would glide to the ground. The toy plane could only glide for a limited time. It would be desirable to provide a toy airplane that minimizes wind drag during launch but can be flown for an extended period after launch.

BRIEF SUMMARY OF THE INVENTION

A toy airplane with foldable wings. The toy airplane includes wings that can move relative to a fuselage between a folded position and an unfolded position. The fuselage contains a motor coupled to a propeller, and a battery that can power the motor. The toy airplane also has a switch that is open when the wings are folded and closed when the wings are in the unfolded position. Power is provided to the motor when the wings are unfolded and the switch is closed.

DETAILED DESCRIPTION

Disclosed is a toy airplane with foldable wings. The wings can be folded before being launched by a launcher. When the toy airplane is launched the wind pressure maintains the wings in the folded position. When the toy airplane reaches a certain reduced speed, springs of the toy plane move the wings back into an unfolded position. Movement of wings into the unfolded position closes a switch and powers a propeller of the toy plane. The propeller can be powered by a battery within the toy plane fuselage. The combination of a motorized propeller, switch and folded wings provides a toy airplane that minimizes drag during launch and allows for extended flight after launch.

Figure 1:
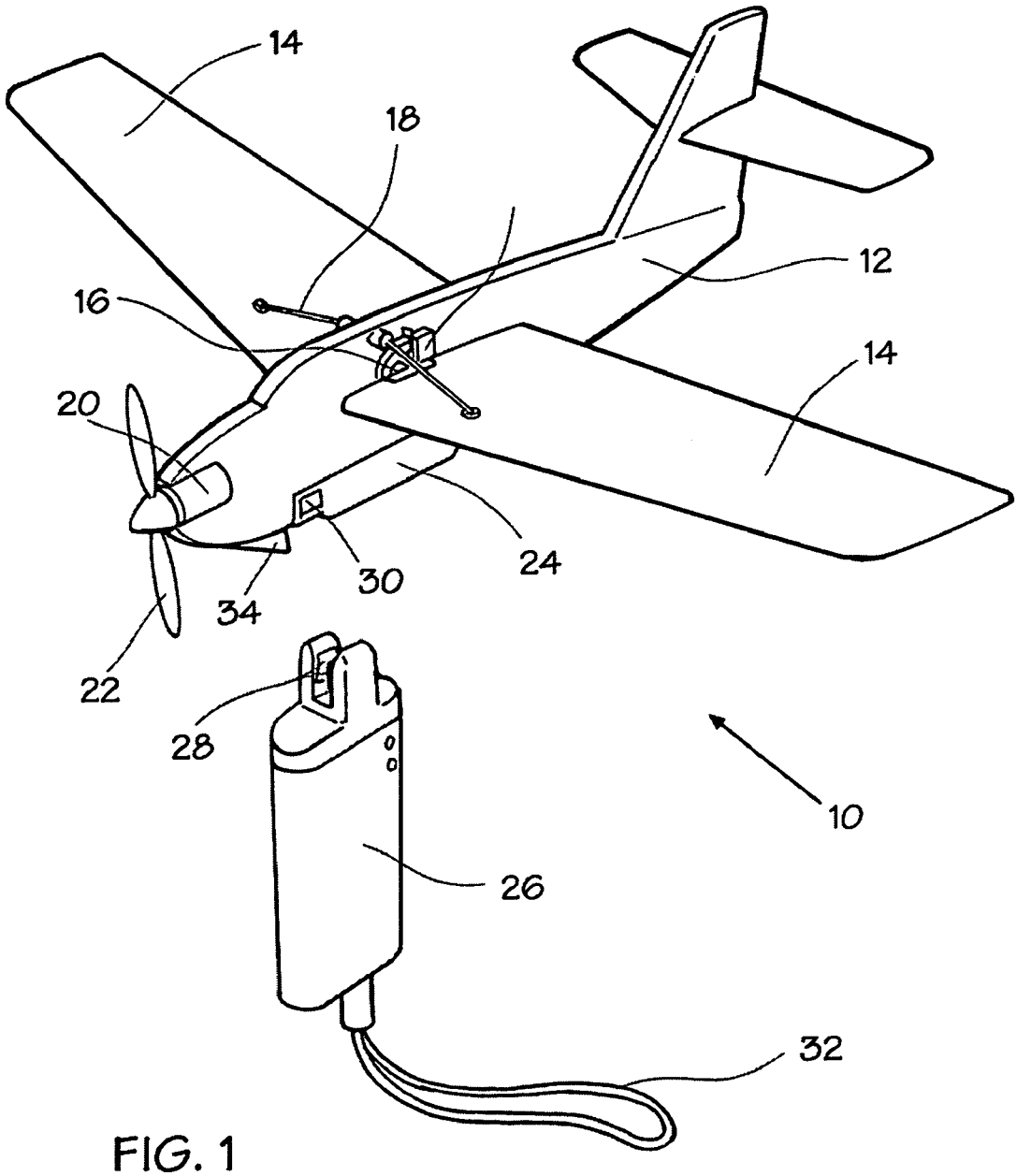
FIG. 1 is an illustration of a toy airplane.

Referring to the drawings more particularly by reference numbers, FIG. 1 shows a toy airplane 10. The toy plane 10 includes a fuselage 12 and a pair of wings 14. The wings 14 are pivotally connected to the fuselage by a hinge 16 and a pair of springs 18. The springs 18 may be rubber bands. The fuselage 12 and wings 14 may be constructed from a lightweight material such as plastic, foam, balsa wood, etc.

The toy airplane 10 includes a motor 20 that can rotate a propeller 22. The motor 20 may receive power from a battery 24. The battery 24 may be charged by a charger 26. The charger 26 may have electrical contacts 28 that mate with electrical contacts 30 of the toy plane 10. The electrical contacts 30 are connected to the battery 24. The charger 26 may also have a spring rubber band 32 that can be attached to a hook 34 of the fuselage 12. The rubber band 32 provides a launch function for the charger 26. Although an integrated charger/launcher is shown and described, it is to be understood that the charger and launcher may be separate devices.

Figure 2:
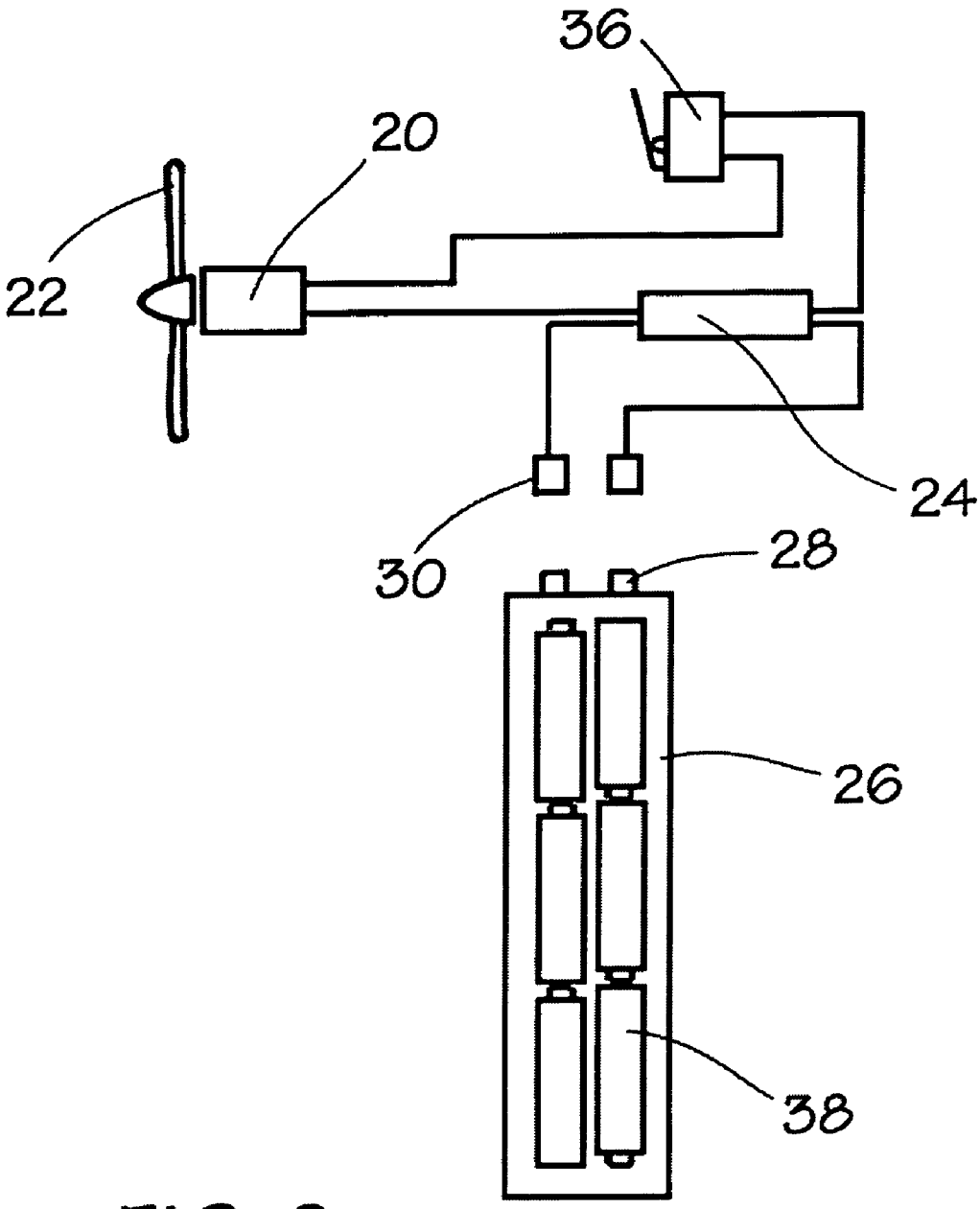
FIG. 2 is an illustration of an electrical system of the toy airplane and a battery charger.

The toy airplane 10 includes a switch 36 that can move between open and closed positions. FIG. 2 shows an illustration of the electrical system of the toy plane 10. The toy plane battery 24 can be charged with batteries 38 within the charger 26 through the contacts 28 and 30. The contacts 28 and 30 may be disconnected when the plane battery 24 is fully charged. The charger 26 may include an LED (not shown) that is illumination, or changes color, when the battery 24 is charged.

When the switch 36 is closed the battery 24 provides electrical current to the motor 20 which rotates the propeller 22. Power is not provided to the motor 20 when the switch 36 is open.

Figure 3:
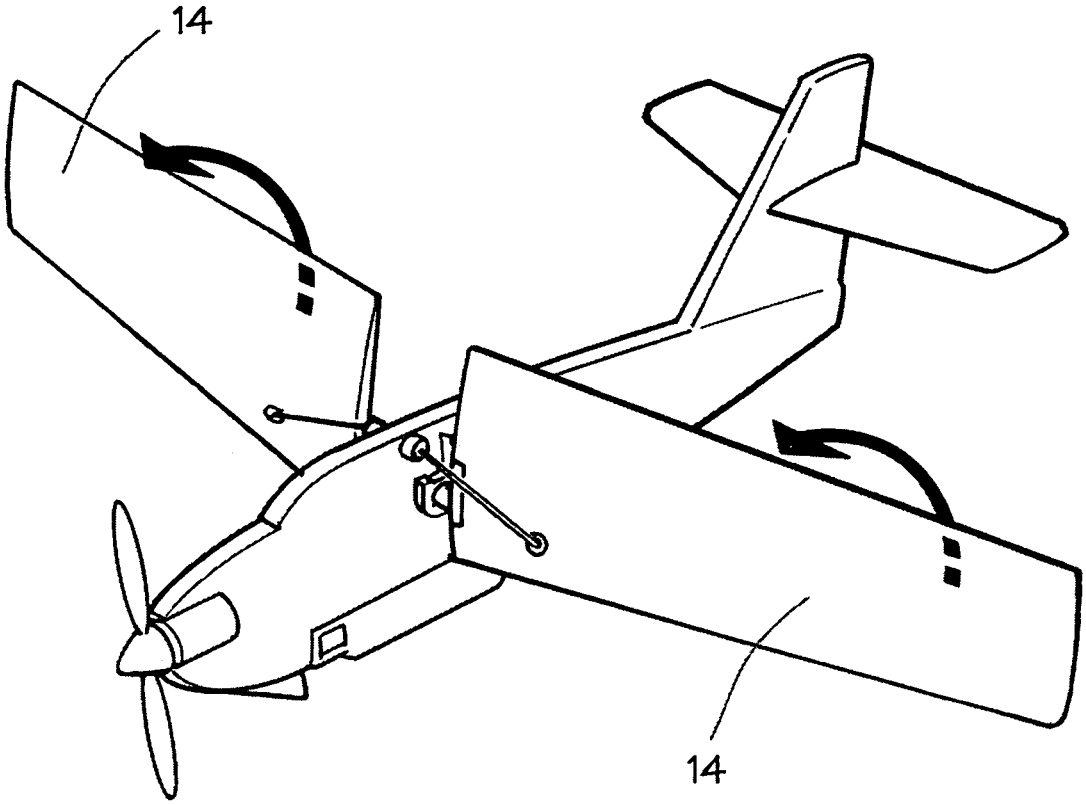
FIG. 3 is an illustration of the toy airplane with the wings turned upward.
Figure 4:
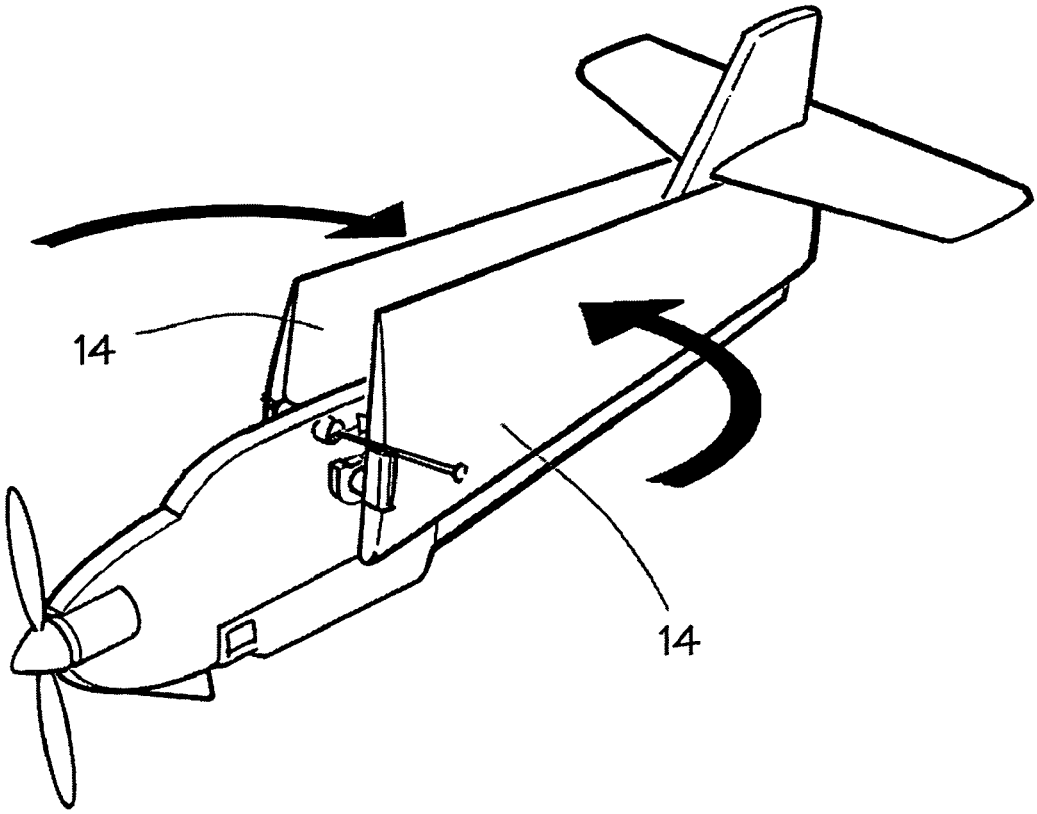
FIG. 4 is an illustration similar to FIG. 3 showing the wings turned backward.
Figure 5:
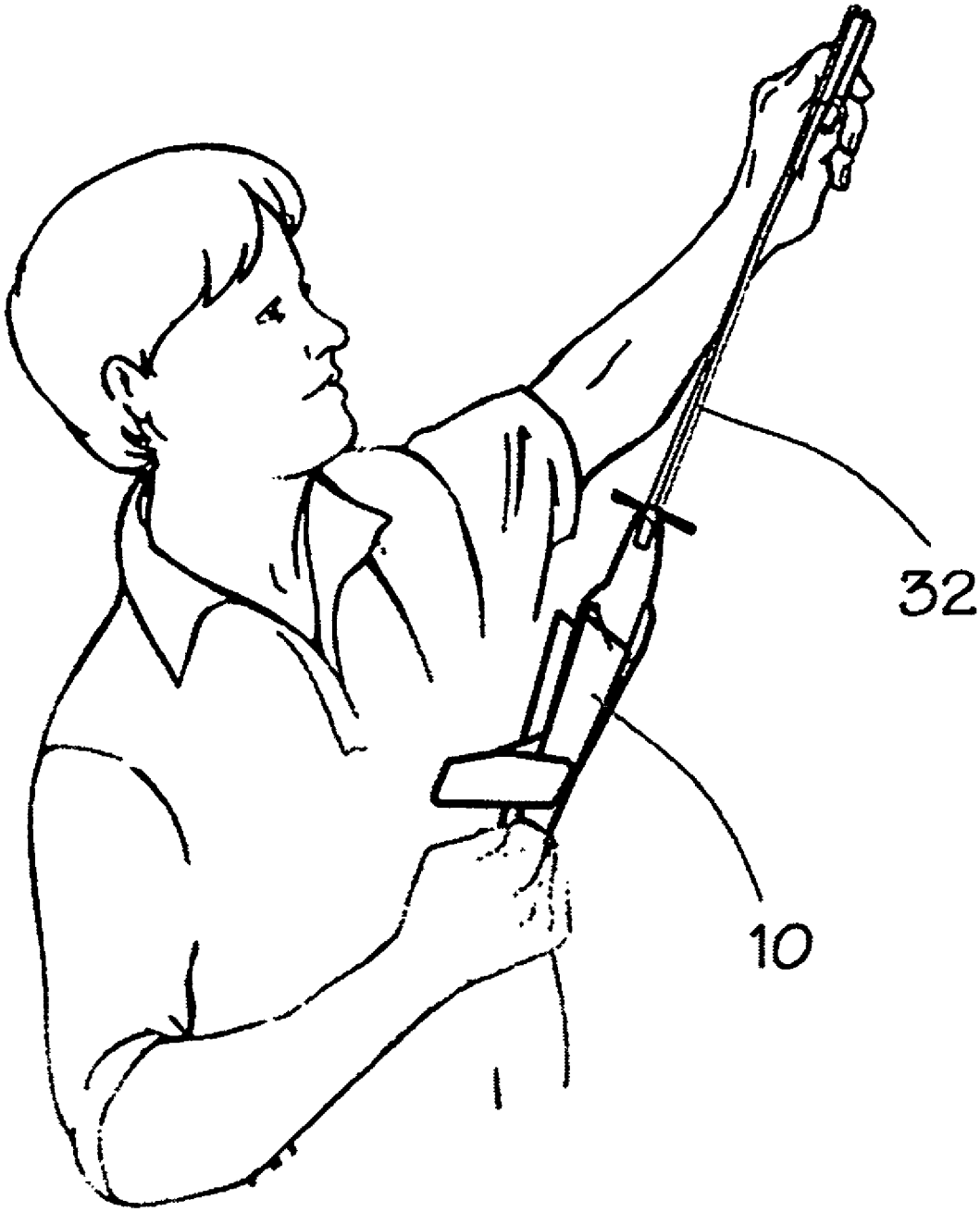
FIG. 5 is an illustration showing the toy airplane about to be launched from a launcher.

FIGS. 3, 4 and 5 show how to operate the toy airplane 10. As shown in FIG. 3 the wings 14 can be initially rotated in an upward direction. The rotation of the wings 14 opens the switch 36. As shown in FIG. 4 the wings 14 can then be pulled back into a folded position. As shown in FIG. 5 the toy plane 10 can be coupled to the rubber band 32 that is then stretched by the user. The rubber band 32 launches the toy plane 10 when the user releases the plane 10.

During the initial flight of the toy plane 10 the wind pressure maintains the wings 14 in the folded position. When the toy plane 10 reduces speed to some threshold level the rubber bands 18 move the wings 14 back to the unfolded position. Movement of the wings 14 to the unfolded position closes the switch 36 and causes rotation of the propeller 22. The toy plane 10 continues to fly through propulsion by the propeller 22.

Figure 6:
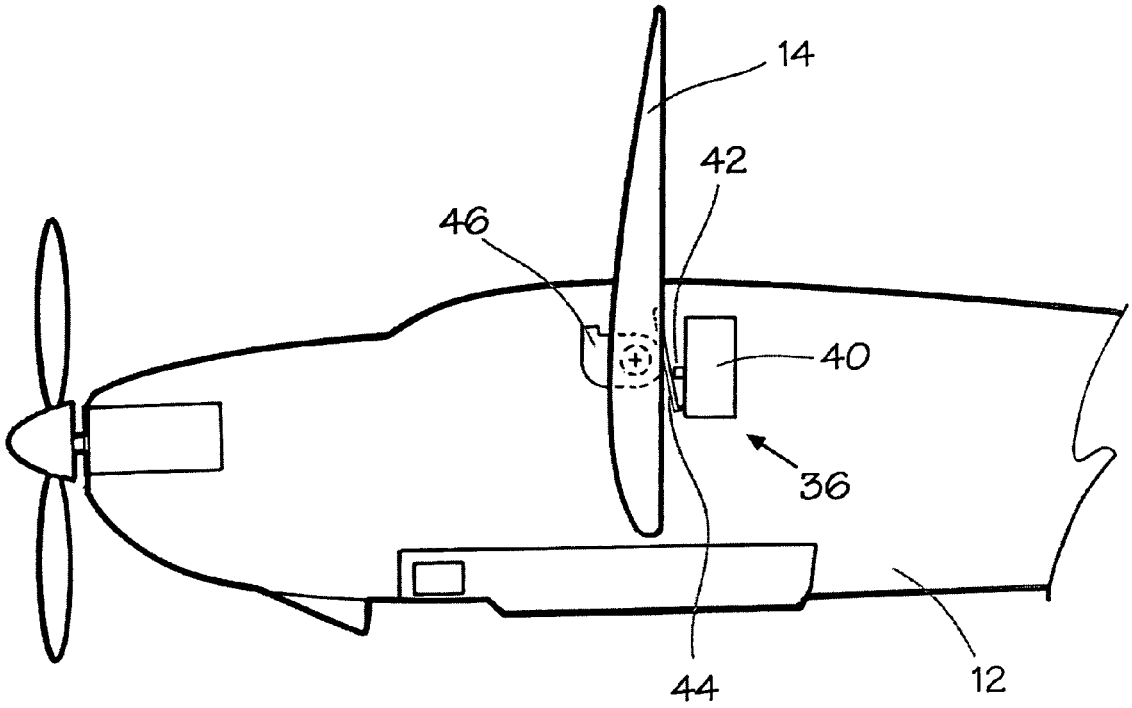
FIG. 6 is an illustration showing a wing in a folded position and a switch in an open position.
Figure 7:
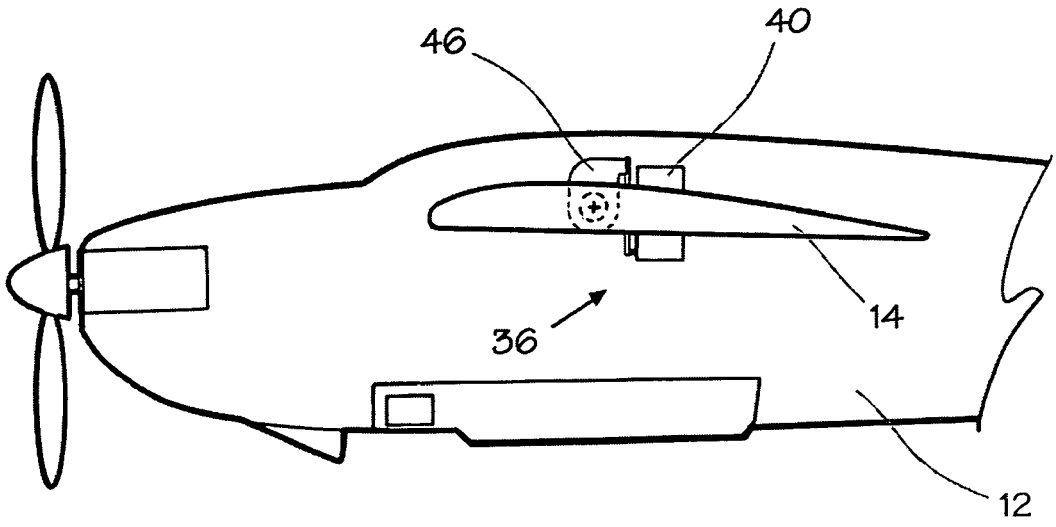
FIG. 7 is an illustration showing the wing in an unfolded position and the switch in a closed position.

FIGS. 6 and 7 show an embodiment of a switch 36. The switch 36 may include a switch box 40 that has a pin 42 and a lever 44. The pin 42 may be spring biased to an outward position. The wing 14 may have a cam 46. As shown in FIG. 6 when the wing 14 is rotated upward, the cam 46 does not engage the lever 44, the pin 42 is in the outward position and the switch 36 is open. As shown in FIG. 7, when the wing 14 is in the unfolded position the cam 46 presses the lever 44 and pushes the pin 42 to an inward position to close the switch 36.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy airplane, comprising:

a fuselage that contains a battery, and a motor coupled to a propeller;

a wing coupled to said fuselage, said wing being moveable between a folded position and an unfolded position while in flight, said wing being in a folded position when the airplane is launched and moves to an unfolded position when a speed of the airplane reduces to a threshold level; and, a switch coupled to said motor and said wing, said switch is open and said motor is disconnected from said battery when said wing is in the folded position, and closed when said wing is in the unfolded position to electrically connect said motor to said battery and rotate said propeller while said fuselage and said wing are in flight.

2. The toy airplane of claim 1, further comprising a spring attached to said fuselage and said wing, said spring biases said wing to the unfolded position.

3. The toy airplane of claim 1, further comprising a launcher coupled said airplane.

4. The toy airplane of claim 3, wherein said launcher includes a launch spring that is coupled to a hook of said fuselage.

5. The toy airplane of claim 1, further comprising a battery charger that is coupled to said battery.

6. The toy airplane of claim 5, wherein said battery charger includes a pair of electrical contacts that mate with a pair of electrical contacts connected to said battery.

7. A toy airplane, comprising:

a fuselage that contains a battery, and a motor coupled to a propeller;

a wing coupled to said fuselage, said wing being moveable between a folded position and an unfolded position while in flight, said wing being in a folded position when the airplane is launched and moves to an unfolded position when a speed of the airplane reduces to a threshold level; and, switch means for connecting said motor to said battery and rotating said propeller when said wing is in the unfolded position while said fuselage and said wing are in flight and disconnecting said motor from said battery when said wing is in the folded position.

8. The toy airplane of claim 7, wherein said motor rotates said propeller when said motor is connected to said battery.

9. The toy airplane of claim 7, further comprising a spring attached to said fuselage and said wing, said spring biases said wing to the unfolded position.

10. The toy airplane of claim 7, further comprising a launcher coupled said airplane.

11. The toy airplane of claim 10, wherein said launcher includes a launch spring that is coupled to a hook of said fuselage.

12. The toy airplane of claim 7, further comprising a battery charger that is coupled to said battery.

13. The toy airplane of claim 12, wherein said battery charger includes a pair of electrical contacts that mate with a pair of electrical contacts connected to said battery.

14. A method for operating a toy airplane, comprising:

moving a wing relative to a fuselage to a folded position so that a switch that can connect a motor to a battery is in an open position;

launching the wing and the fuselage while the wing is in the folded position;

moving the wing to an unfolded position to close the switch and connect the motor to the battery when a speed of the airplane reduces to a threshold level; and, rotating a propeller connected to the fuselage with the motor while the fuselage and the wing are in flight.

15. The method of claim 14, wherein the wing and fuselage are launched with a spring loaded launcher.

16. The method of claim 14, further comprising charging a battery coupled to the propeller before the wing and fuselage is launched.

17. The method of claim 14, wherein the wing is moved to the unfolded position by a spring.

* * * * *